US006592638B2

(12) United States Patent
Krull et al.

(10) Patent No.: US 6,592,638 B2
(45) Date of Patent: Jul. 15, 2003

(54) MIXTURES OF CARBOXYLIC ACIDS, THEIR DERIVATIVES AND HYDROXYL-CONTAINING POLYMERS AND THEIR USE FOR IMPROVING THE LUBRICATING EFFECT OF OILS

(75) Inventors: Matthias Krull, Oberhausen (DE); Werner Reimann, Frankfurt am Main (DE)

(73) Assignee: Clariant GmbH, Frankfurt (DE)

( * ) Notice: Subject to any disclaimer, the term of this patent is extended or adjusted under 35 U.S.C. 154(b) by 118 days.

(21) Appl. No.: 09/811,307

(22) Filed: Mar. 16, 2001

(65) Prior Publication Data

US 2001/0034308 A1 Oct. 25, 2001

(30) Foreign Application Priority Data

Mar. 16, 2000 (DE) ..... 100 12 946

(51) Int. Cl.[7] ..... C10L 1/18; C10L 1/24

(52) U.S. Cl. ..... 44/383; 385/388; 385/389; 385/393; 385/394; 385/404; 385/447; 44/451; 524/186; 524/282; 524/284; 524/294; 524/295; 524/296; 524/298; 524/366; 524/379

(58) Field of Search ..... 44/385, 388, 393, 44/394, 383, 418, 404, 389, 447, 451; 524/186, 210, 282, 284, 294, 295, 296, 298, 366, 379

(56) References Cited

U.S. PATENT DOCUMENTS

| | | | | | |
|---|---|---|---|---|---|
| 3,454,378 | A | * | 7/1969 | Singh | 44/393 |
| 4,155,719 | A | * | 5/1979 | Sweeney | 44/393 |
| 4,211,534 | A | | 7/1980 | Feldman | |
| 4,452,610 | A | * | 6/1984 | Waite | 44/392 |
| 4,670,516 | A | | 6/1987 | Sackmann et al. | |
| 4,985,048 | A | | 1/1991 | Wirtz et al. | |
| 5,186,720 | A | | 2/1993 | Feustel et al. | |
| 5,391,632 | A | | 2/1995 | Krull et al. | |
| 6,010,989 | A | | 1/2000 | Krull et al. | |
| 6,281,292 | B1 | | 8/2001 | Krull et al. | |

FOREIGN PATENT DOCUMENTS

| | | | | | |
|---|---|---|---|---|---|
| CA | 2287660 | A1 | * | 4/2000 | C10L/1/14 |
| DE | 197 57 830 | | | 7/1999 | |
| DE | 198 56 270 | | | 5/2000 | |
| EP | 0 153 176 | | | 8/1985 | |
| EP | 0 154 177 | | | 9/1985 | |
| EP | 0 271 738 | | | 6/1988 | |
| EP | 0 320 766 | | | 6/1989 | |
| EP | 0 413 279 | | | 2/1991 | |
| EP | 606 055 | | | 7/1994 | |
| EP | 0 680 506 | | | 11/1995 | |
| EP | 0 807 676 | | | 11/1997 | |
| EP | 0 900 836 | | | 3/1999 | |
| EP | 0 926 168 | | | 6/1999 | |
| EP | 0 960 908 | | | 12/1999 | |
| EP | 0 997 517 | | | 5/2000 | |
| WO | WO 9607682 | A1 | * | 3/1996 | C08F/218/10 |
| WO | WO 9607719 | A1 | * | 3/1996 | C10L/1/18 |
| WO | 96/18708 | | | 6/1996 | |
| WO | WO 96/18708 | | | 6/1996 | |
| WO | WO 96/21709 | | | 7/1996 | |
| WO | WO 97/45507 | | | 12/1997 | |
| WO | WO 99/36489 | | | 7/1999 | |

OTHER PUBLICATIONS

U.S. patent application Ser. No. 09/213,648.
Derwent Patent Family Abstract for EP 0 271 738.
Derwent Patent Family Abstract for DE 198 56 270.
German office action.
Ullmann's encyclopedia der Techn, Chemie, 4. Auflage, vol. 19, p. 196–178.
J. Poly. Sci Macromolecular Revs., Comb–like Polymers, Structure & Properties, N.A. Plate, & V.P. Shibaev, 1974, 8, p.117ff.
D. Wie, H. Spiekes, Wear, vol. 111, No. 2, p.217–235, 1986.
EPO Search Report for EP Application No. 01104845, mail date Jan. 16, 2002.
U.S. patent application Ser. No. 09/213,648, filed Dec. 16, 1998.
U.S. patent application Ser. No. 09/427,352, filed Oct. 26, 1999.
U.S. patent application Ser. No. 09/811,306, filed Mar. 16, 2001.

* cited by examiner

*Primary Examiner*—Cephia D. Toomer
(74) *Attorney, Agent, or Firm*—Richard P. Silverman

(57) ABSTRACT

The invention relates to additives for improving lubricating properties of fuel oils, comprising A) 10–95% by weight of at least one oil-soluble amphiphile which comprises nitrogen- or oxygen-containing groups substituted by alkyl, alkenyl, hydroxyalkyl or aromatic radicals, and B) 5–90% by weight of at least one copolymer which contains B1) from 0.5 to 15 mol % of structural units which are derived from olefinically unsaturated compounds which have at least one free hydroxyl group, and B2) from 85 to 99.5 mol % of structural units which are derived from ethylene, and, if required, B3) from 0 to 20 mol % of further structural units selected from the group consisting of (meth)acrylic acid, (meth) acrylates, vinyl esters, vinyl ethers and alkenes, and the copolymer has an average molar mass Mw of from 500 to 100,000 g/mol and an OH number of from 5 to 500 mg KOH/g.

8 Claims, No Drawings

MIXTURES OF CARBOXYLIC ACIDS, THEIR DERIVATIVES AND HYDROXYL-CONTAINING POLYMERS AND THEIR USE FOR IMPROVING THE LUBRICATING EFFECT OF OILS

FIELD OF THE INVENTION

The present invention relates to an additive which comprises a long-chain carboxylic acid and/or its derivatives and one or more hydroxyl-containing polymers, fuel oils which contain such additives and the use of such additives for improving the lubricity of middle distillates.

BACKGROUND OF THE INVENTION

Mineral oils and mineral oil distillates which are used as fuel oils contain in general 0.5% by weight or more of sulfur, which results in the formation of sulfur dioxide on combustion. To reduce the resulting environmental pollution, the sulfur content of fuel oils is being increasingly reduced. The introduction of standard EN 590 relating to diesel fuels currently prescribes a maximum sulfur content of 350 ppm in Germany. In Scandinavia, fuel oils containing less than 50 ppm and in exceptional cases less than 10 ppm of sulfur are already in use. These fuel oils are produced as a rule by subjecting the fractions obtained from mineral oil by distillation to refinement involving hydrogenation. However, the desulfurization also results in the removal of other substances which impart a natural lubricating effect to the fuel oils. These substances include polyaromatic and polar compounds.

However, it has been found that the friction- and wear-reducing properties of fuel oils deteriorate with an increasing degree of desulfurization. Often, these properties are so poor that corrosion phenomena have to be expected after only a short time on the materials lubricated with fuel, for example the distributor injection pumps of diesel engines. The maximum value of 360° C. for the 95% distillation point specified according to EN 590 since the year 2000 and the further reduction of the 95% distillation point to below 350° C. and in some cases below 330° C., now implemented in Scandinavia, have further intensified these problems.

The prior art therefore describes approaches which are intended to solve this problem (so-called lubricity additives).

EP-A-0 743 974 discloses the use of mixtures of lubricity additives (esters of polyhydric alcohols and carboxylic acids having 10 to 25 carbon atoms or dicarboxylic acids) and flow improvers based on copolymers of ethylene and unsaturated esters for the synergistic improvement of the lubricating effect of highly desulfurized oils.

EP-A-0 802 961 discloses fuel oils which contain at least one hydroxylamine for improving their lubricating effect.

WO-99/36 489 discloses the use of mixtures of monomeric and polymeric fatty acids for improving the lubricating effect of low-sulfur middle distillates.

DE-A-197 57 830 discloses that hydroxyl-containing polymers can be used as a mixture with acid derivatives. However, no technical advantages of such mixtures are disclosed and furthermore no examples of these are given.

EP-A-0 807 676 discloses a fuel oil additive which increases the lubricity of said fuel oil and which, in addition to a carboxamide, comprises a cold flow improver and an ashless dispersant.

EP-A-0 680 506 discloses the use of esters of monobasic or polybasic carboxylic acids with monohydric or polyhydric alcohols as lubricity additives for fuel oils.

The lubricity additives of the prior art have, as far as polymers are concerned, the disadvantage that, owing to their high viscosity, they have to be used as a solution or dispersion in suitable solvents in order to improve their handling. However, the use of solvents results in increased metering rates and hence in the transport of larger amounts of substances. Owing to their amphiphilic character, the nonpolymeric additives often have a pronounced tendency to emulsify. Consequently, the residual water present in storage tanks is converted into stable emulsions with the middle distillates, which can then lead to problems with respect to corrosiveness and cold flow properties.

SUMMARY OF THE INVENTION

It was thus the object of the present invention to provide additive compositions which have little tendency to emulsify and are also effective when used as additives in small amounts.

DESCRIPTION OF THE PREFERRED EMBODIMENTS

Surprisingly, it was found that additive combinations comprising oil-soluble amphiphiles and hydroxyl-containing copolymers have the disadvantages of the prior art in a substantially reduced manner.

The invention relates to additives for improving lubricating properties of fuel oils, comprising A) 10–95% by weight of at least one oil-soluble amphiphile of the formulae 1

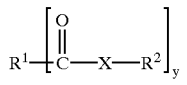

(1)

and/or 2

(2)

in which $R^1$ is an alkyl, alkenyl, hydroxyalkyl or aromatic radical having 1 to 50 carbon atoms, X is NH, $NR^3$, O or S, y is 1, 2, 3 or 4, $R^2$ is hydrogen or an alkyl radical carrying hydroxyl groups and having 2 to 10 carbon atoms and $R^3$ is an alkyl radical carrying nitrogen and/or hydroxyl groups and having 2 to 10 carbon atoms or a $C_1$–$C_{20}$-alkyl radical, and B) 5–90% by weight of at least one copolymer which contains B1) from 0.5 to 15 mol % of structural units which are derived from olefinically unsaturated compounds which have at least one free hydroxyl group B2) from 85 to 99.5 mol % of structural units which are derived from ethylene, and, if required, B3) from 0 to 20 mol % of further structural units selected from the group consisting of (meth)acrylic acid, (meth) acrylates, vinyl esters, vinyl ethers and alkenes, with the proviso that the structural units stated under B3) differ from the structural units stated under B1) and B2), and the copolymer has an average molar mass Mw of from 500 to 100,000 g/mol and an OH number of from 5 to 300 mg KOH/g.

The invention furthermore relates to fuel oils which contain said additives.

The invention furthermore relates to the use of the additives for improving the lubricating properties of fuel oils.

The invention furthermore relates to a process for improving the lubricity of fuel oils.

The oil-soluble amphiphile (component A) comprises preferably a radical $R^1$ having 5 to 40, in particular 12 to 26, carbon atoms. Particularly preferably, $R^1$ is linear or branched and, in the case of linear radicals, contains from 1 to 3 double bonds. The radical $R^2$ preferably has 2 to 8, especially 2 to 6 carbon atoms, and may be interrupted by nitrogen and/or oxygen atoms. In a further preferred embodiment, the sum of the carbon atoms of $R^1$ and $R^2$ is at least 10, in particular at least 15 and not more than 35, in particular not more than 28, carbon atoms. In a further preferred embodiment, the component A carries from 2 to 5 hydroxyl groups, each carbon atom carrying not more than one hydroxyl group.

In a preferred embodiment of the invention, X in the formula 1 is oxygen. These compounds are in particular fatty acids and esters of carboxylic acids and dihydric or polyhydric alcohols. Preferred esters contain at least 10, in particular at least 12, carbon atoms. It is also preferred if the esters contain free hydroxyl groups, i.e. the esterification of the polyol with the carboxylic acid is not complete. Suitable polyols are, for example, ethylene glycol, diethylene glycol and higher alkoxylation products, glycerol, trimethylolpropane, pentaerythritol and sugar derivatives. Further polyols containing hetero atoms, such as triethanolamine, are also suitable. In a further preferred embodiment of the invention, the compounds which form the component A of the additive are fatty acids having 10 to 22 carbon atoms. These may be saturated or unsaturated.

Preferred components A are straight-chain saturated fatty acids having up to 18 carbon atoms, such as caprylic acid (octanoic acid), capric acid (decanoic acid), lauric acid (dodecanoic acid), myristic acid (tetradecanoic acid), palmitic acid (hexadecanoic acid), stearic acid (octadecanoic acid), and in particular unsaturated fatty acids, such as oleic acid (octadecenoic acid), linoleic acid, linolenic acid and mixtures thereof, such as, for example, rapeseed oil acid, soybean fatty acid, sunflower fatty acid, peanut fatty acid and tall oil fatty acid. Furthermore, dimeric and oligomeric fatty acids, as formed in the oligomerization of unsaturated fatty acids, may be present. Preferably, at least 50%, in particular more than 70%, especially more than 90%, of the fatty acids have at least one double bond.

Oil-soluble partial esters of these fatty acids with polyols, such as, for example, ethylene glycol, diethylene glycol and higher oligomers of alkylene oxides and glycerol, pentaerythritol, sorbitol, diethanolamine, triethanolamine and alkoxylated polyamines, are furthermore preferred. Glyceryl monooleate is particularly preferred. Esters which carry at least two free OH groups and an alkyl radical having at least 8 carbon atoms are especially preferred. The esters preferably have OH numbers of from 10 to 200 mg KOH/g, preferably from 20 to 150 mg KOH/g. $R^3$ is preferably methyl or ethyl.

If X is a nitrogen-containing radical, reaction products of ethanolamine, diethanolamine, hydroxypropylamine, dihydroxypropylamine, n-methylethanolamine, diglycolamine and 2-amino-2-methylpropanol are suitable. The reaction is preferably carried out by amidation, the resulting amides also carrying free OH groups. Fatty acid monoethanolamides, fatty acid diethanolamides and fatty acid N-methylethanolamides may be mentioned as examples.

In one embodiment, the multifunctional additive may contain, as component A, compounds of the formula 3

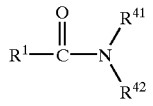

(3)

in which $R^1$ has the abovementioned meaning, $R^{41}$ is a radical of the formula 3a $$—(R^{43}—NR^{44})_m—R^{45} \quad (3a)$$

and $R^{42}$ is a radical of the formula 3b $$—(R^{43}—NR^{44})_n—R^{45} \quad (3b),$$

$R^{43}$ is a $C_2$- to $C_{10}$-alkylene group, $R^{44}$ is hydrogen, methyl, $C_2$- to $C_{20}$-alkyl, a radical of the formula 3c

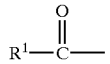

(3c)

or an alkoxy radical, and $R^{45}$ is H or a radical of the formula 3c, and m and n, in each case independently of one another, are an integer from 0 to 20, a) m and n preferably not simultaneously being zero and b) the sum of m and n being at least 1 and not more than 20.

$R^{43}$ is preferably a $C_2$- to $C_8$-radical, in particular a $C_2$- to $C_4$-radical. The polyamine from which the structural unit formed from $R^{41}$, $R^{42}$ and the nitrogen atom linking them is derived is preferably ethylenediamine, diethylenetriamine, triethylenetetramine, tetraethylenepentamine or a higher homolog of aziridine, such as polyethyleneimine, and mixtures thereof. Some of the amino groups may be alkylated. Star amines and dendrimers are also suitable. These are understood as meaning polyamines having in general 2–10 nitrogen atoms which are linked to one another via $—CH_2—CH_2—$ groups and which are saturated by acyl or alkyl radicals in the outer position.

$R^{44}$ is preferably nitrogen, an acyl radical or an alkoxy group of the formula $—(OCH_2CH_2)_n—$, where n is an integer from 1 to 10, or a mixture thereof.

Other suitable amphiphiles are compounds of the formula 3d

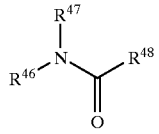

(3d)

in which $R^{46}$ may have the same meaning as $R^1$, $R^{47}$ may have the same meaning as $R^1$ or is H or $—[CH_2—CH_2—O—]_p—H$ and $R^{48}$ may have the same meaning as $R^2$ and p is an integer from 1 to 10, with the proviso that at least one of the radicals $R^{46}$, $R^{47}$ and $R^{48}$ carries an OH group. γ-Hydroxybutyric acid tallow fatty amide may be mentioned as an example.

The amides are generally prepared by condensation of the polyamines with the carboxylic acids or their derivatives, such as esters or anhydrides. Preferably from 0.2 to 1.5 mol, in particular from 0.3 to 1.2 mol, especially 1 mol, of acid are used per base equivalent. The condensation is preferably carried out at temperatures of from 20 to 300° C., in particular from 50 to 200° C., with removal of the water of reaction by distillation. For this purpose, solvents, preferably aromatic solvents, such as benzene, toluene, xylene, trimethylbenzene and/or commercial solvent mixtures, such as, for example, Solvent Naphtha, ®Shellsol AB, ®Solvesso 150 or ®Solvesso 200, may be added to the reaction mixture. The products according to the invention generally have a titratable base nitrogen content of 0.01–5% and an acid number of less than 20 mg KOH/g, preferably less than 10 mg KOH/g.

y preferably assumes the value 1 or 2. Examples of preferred groups of compounds having y=2 are derivatives of dimeric fatty acids and alkenylsuccinic anhydrides. The latter may carry linear as well as branched alkyl radicals, i.e. they may be derived from linear α-olefins and/or from oligomers of lower $C_3$–$C_5$-olefins, such as poly(propylene) or poly(isobutylene).

Preferred polyols have 2 to 8 carbon atoms. They preferably carry 2, 3, 4 or 5 hydroxyl groups, but no more than the carbon atoms they contain. The carbon chain of the polyols may be straight, branched, saturated or unsaturated and, if required, may contain hetero atoms. It is preferably saturated.

Preferred carboxylic acids from which the radical $R^1$ is derived have 5 to 40, in particular 12 to 30, carbon atoms. Preferably, the carboxylic acid has one or two carboxyl groups. The carbon chain of the carboxylic acids may be straight, branched, saturated or unsaturated. Preferably, more than 50% of the carboxylic acids (mixtures) used contain at least one double bond. Examples of preferred carboxylic acids include caprylic acid, capric acid, lauric acid, myristic acid, palmitic acid, stearic acid, oleic acid, elaidic acid, linoleic acid, linolenic acid and behenic acid, as well as carboxylic acids having hetero atoms, such as ricinoleic acid. Furthermore, dimeric and trimeric fatty acids, as are obtainable, for example, by oligomerization of unsaturated fatty acids, and alkenylsuccinic acids may be used.

In a preferred embodiment, ethers and amines of the formula 2 are used as component A. These are partial ethers of polyols, such as, for example, glyceryl monooctadecyl ether or amines carrying hydroxyl groups, as obtainable, for example, by alkoxylation of amines of the formula $R^1NH_2$ or $R^1R^3NH$ with alkylene oxides, preferably ethylene oxide and/or propylene oxide. Preferably, 1–10, in particular 1–5, mol of alkylene oxide are used per H atom of the nitrogen.

The copolymer which forms component B of the additive according to the invention contains free OH groups.

In a preferred embodiment of the invention, the proportion of structural units (B1) is from 1 to 15, in particular from 3 to 12, mol %. In a further preferred embodiment, the copolymer has an OH number of from 10 to 300, in particular from 20 to 200, mg KOH/g. In a further preferred embodiment, the copolymer has an average molecular weight Mw of from 700 to 10,000 g/mol.

The olefinically unsaturated compounds which are the comonomers (B1) are preferably vinyl esters, acrylates, mono- and diesters of ethylenically unsaturated carboxylic acids, methacrylates, alkyl vinyl ethers and/or alkenes, which carry hydroxyalkyl, hydroxyalkenyl, hydroxycycloalkyl or hydroxyaryl radicals. These radicals contain at least one hydroxyl group which may be in any desired position of the radical but is preferably at the chain end (ω-position) or in the para-position in the case of ring systems.

The vinyl esters are preferably those of the formula 4

$$CH_2{=}CH{-}OCOR^4 \quad (4)$$

in which $R^4$ is $C_1$–$C_{30}$-hydroxyalkyl, preferably $C_1$–$C_{16}$-hydroxyalkyl, especially $C_2$–$C_{12}$-hydroxyalkyl and the corresponding hydroxyoxalkyl radicals. Suitable vinyl esters include 2-hydroxyethyl vinyl esters, α-hydroxypropyl vinyl esters, 3-hydroxypropyl vinyl esters and 4-hydroxybutyl vinyl esters.

The acrylates are preferably those of the formula 5

$$CH_2{=}CR^5{-}COOR^6 \quad (5)$$

in which $R^5$ is hydrogen or methyl and $R^6$ is $C_1$–$C_{30}$-hydroxyalkyl, preferably $C_1$–$C_{16}$-hydroxyalkyl, especially $C_2$–$C_{12}$-hydroxyalkyl and the corresponding hydroxyoxalkyl radicals. Suitable acrylates include hydroxyethyl acrylate, hydroxyethyl methacrylate, 2-hydroxypropyl acrylate, 3-hydroxypropyl acrylate, 3-hydroxypropyl methacrylate, hydroxyisopropyl acrylate, 4-hydroxybutyl acrylate and glyceryl monoacrylate. The corresponding esters of methacrylic acid and esters of ethylenically unsaturated dicarboxylic acids, such as maleic acid, fumaric acid or itaconic acid, with diols are just as suitable.

The alkyl vinyl ethers are preferably compounds of the formula 6

$$CH_2{=}CH{-}OR^7 \quad (6)$$

in which $R^7$ is $C_1$–$C_{30}$-hydroxyalkyl, preferably $C_1$–$C_{16}$-hydroxyalkyl, especially $C_2$–$C_{12}$-hydroxyalkyl and the corresponding hydroxyoxalkyl radicals. Suitable alkyl vinyl ethers include 2-hydroxyethyl vinyl ether, hydroxypropyl vinyl ether, hexanediol monovinyl ether, 4-hydroxybutyl vinyl ether, diethylene glycol monovinyl ether and cyclohexanedimethanol monovinyl ether.

The alkenes are preferably monounsaturated hydroxyhydrocarbons having 3 to 30 carbon atoms, in particular 4 to 16 carbon atoms and especially 5 to 12 carbon atoms. Suitable alkenes include dimethylvinylcarbinol (=2-methyl-3-buten-2-ol), allyloxypropanediol, 2-butene-1,4-diol, 1-buten-3-ol, 3-buten-1-ol, 2-buten-1-ol, 1-penten-3-ol, 1-penten-4-ol, 2-methyl-3-buten-1-ol, 1-hexen-5-ol, 5-hexen-1-ol and 7-octene-1,2-diol.

If required, up to 20 mol % of one or more olefinically unsaturated comonomers may be present as further comonomers B3). Suitable comonomers are, for example, acrylic acid or methacrylic acid, acrylates of alcohols having 1 to 20 carbon atoms, in particular methyl acrylate, ethyl acrylate, propyl acrylate, butyl acrylate and ethylhexyl acrylate, and the corresponding methacrylates, vinyl esters, such as vinyl acetate, vinyl propionate, hexylvinyl esters and vinyl esters of neocarboxylic acids having 8, 9, 10, 11 or 12 carbon atoms, vinyl ethers and olefins having 3 to 20 carbon atoms, such as propene, butene, isobutene, pentene, hexene, 4-methylpentene, diisobutylene and norbornene.

Nitrogen-containing monomers may also be present, such as, for example, a) aminoalkyl acrylates and methacrylates, such as, for example, aminoethyl acrylate, aminopropyl acrylate, amino-n-butyl acrylate, N-methylaminoethyl acrylate, N,N-dimethylaminoethyl acrylate, N,N-diethylaminoethyl acrylate, N,N-dimethylaminopropyl acrylate, N,N-diethylaminopropyl acrylate and the corresponding methacrylates, b) alkylacrylamides and alkylmethacrylamides, such as, for example, ethylacrylamide, butylacrylamide, N-octylacrylamide, N-propyl-N-methoxyethylacrylamide, N-acryloylphthalimide, N-acryloylsuccinimide, N-methylolacrylamide and the corresponding methacrylamides, c) vinylamides, such as, for example, N-vinyl-N-methylacetamide and N-vinylsuccinimide, d) aminoalkyl vinyl ethers, such as, for example, aminopropyl vinyl ether, diethylaminoethyl vinyl ether and diethylaminopropyl vinyl ether, e) allylamine, N-allyl-N-methylamine, N-allyl-N-ethylamine and diallylamine, and f) a heterocycle carrying a vinyl group, such as, for example, N-vinylpyrrolidone, methylvinylimidazole, 2-vinylpyridine, 4-vinylpyridine, 2-methyl-5-vinylpyridine, vinylcarbazole, vinylimidazole, N-vinyl-2-piperidone and N-vinylcaprolactam.

The melt viscosities of the copolymers at 140° C. are preferably below 10,000 mPas, in particular from 10 to 2000 mPas and especially from 15 to 1000 mPas. In the context of the invention, oil-soluble means that at least 10% by weight, preferably at least 1% by weight, in particular at least 0.1% by weight, of the additive is soluble in the middle distillate into which the additive is to be introduced and gives a clear solution.

The copolymers which form the component B of the additive according to the invention can be prepared by direct polymerization of compounds which contain the stated structural units. It is also possible to prepare them by a polymer-analogous reaction.

The copolymerization of the comonomers is carried out by known methods (in this context, cf. for example Ullmanns Encyclopädie der Technischen Chemie [Ullmann's Encyclopedia of Industrial Chemistry], 4th Edition, Vol. 19, pages 169 to 178). Polymerization in solution, in suspension and in the gas phase and high-pressure mass polymerization are suitable. High-pressure mass polymerization is preferably used and is carried out at pressures of from 50 to 400 MPa, preferably from 100 to 300 MPa, and temperatures of from 50 to 350° C., preferably from 100 to 300° C. The reaction of the comonomers is initiated by free radical initiators (free radical chain initiators). This class of substances includes, for example, oxygen, hydroperoxides, peroxides and azo compounds, such as cumyl hydroperoxide, tert-butyl hydroperoxide, dilauroyl peroxide, dibenzoyl peroxide, bis(2-ethylhexyl) peroxodicarbonate, tert-butyl permaleate, tert-butyl perbenzoate, dicumyl peroxide, tert-butyl cumyl peroxide, di(tert-butyl) peroxide, 2,2'-azobis(2-methylpropanonitrile) and 2,2'-azobis(2-methylbutyronitrile). The initiators are used individually or as a mixture of two or more substances, in amounts of from 0.01 to 20% by weight, preferably from 0.05 to 10% by weight, based on the comonomer mixture.

For a given composition of the comonomer mixture, the desired melt viscosity of the copolymer is established by varying the reaction parameters of pressure and temperature and, if required, by adding moderators. Hydrogen, saturated or unsaturated hydrocarbons, e.g. propane, aldehydes, e.g. propionaldehyde, n-butyraldehyde or isobutyraldehyde, ketones, e.g. acetone, methyl ethyl ketone, methyl isobutyl ketone or cyclohexanone, or alcohols, e.g. butanol, have proven useful as moderators. Depending on the desired viscosity, the moderators are used in amounts of up to 20% by weight, preferably from 0.05 to 10% by weight, based on the comonomer mixture.

The high-pressure mass polymerization is carried out batchwise or continuously in known high-pressure reactors, e.g. autoclaves or tubular reactors, tubular reactors having proven to be particularly useful. Solvents, such as aliphatic hydrocarbons or hydrocarbon mixtures, benzene or toluene, may be present in the reaction mixture, although the solvent-free procedure has proven to be particularly useful. According to a preferred embodiment of the polymerization, the mixture of the comonomers, the initiator and, if used, the moderator is fed to a tubular reactor via the reactor entrance and via one or more side branches. Here, the comonomer streams may have different compositions (EP-B-0 271 738).

Furthermore, the lubricating effect of oils can be improved in a manner according to the invention by adding to them copolymers which are obtained by oxalkylation of copolymers containing acid groups. Ethylene copolymers suitable for this purpose are, for example, those of acrylic acid, methacrylic acid, itaconic acid, fumaric acid, maleic acid or maleic anhydride. For the preparation of an additive which improves the lubricating effect of oils, these copolymers containing acid groups are oxalkylated at the acid groups with $C_1$- to $C_{10}$-alkylene oxides. Preferred alkylene oxides are ethylene oxide, propylene oxide and butylene oxide. The oxalkylation is preferably effected using from 0.5 to 10 mol, in particular from 1 to 5 mol and especially from 1 to 2 mol of alkylene oxide per mole of acid group.

For the preparation of the copolymers according to the invention by means of polymer-analogous reaction, the polymeric acid groups can also be reacted with at least bifunctional reagents which carry at least one OH function. The bonding to the polymer may take place via hydroxyl groups as ester and/or via primary or secondary amino groups in the form of amides, imides and/or ammonium salts. In order to avoid crosslinking reactions, it is possible to employ, for example, an excess of bifunctional reagent and/or a high dilution. The esterification, amidation or imidation is carried out as a rule with removal of water of reaction (azeotropic distillation, expulsion with gas stream, such as $N_2$). The residual acid number is brought to values of <150, preferably <20, in particular <10 mg, KOH/g. Examples of suitable reagents are ethylene glycol, propylene glycol, diethylene glycol, triethylene glycol, trimethylolpropane, mixed alkoxylates of ethylene oxide, propylene oxide and/or butylene oxide comprising up to 50, in particular up to 10 units derived from ethylene oxide, propylene oxide and/or butylene oxide, glycerol, pentaerythritol, sorbitol, ethanolamine, diethanolamine, triethanolamine, butyldiethanolamine, methyl diisopropylamine, aminopropanediol and alkoxylated polyamines. The latter may be derived, for example, from ethylenediamine, hexamethylenediamine, diethylenetriamine, triethylenetetramine, tetraethylenepentamine and their higher homologs, which are alkoxylated with from 0.5 to 50, in particular 10, mol of ethylene oxide, propylene oxide and/or butylene oxide per H atom bonded to a N atom. The reaction with the polymer can be effected both via an OH group to give the ester and via a primary or secondary amino group to give the amide or imide.

The reaction of the copolymers containing acid groups is carried out at from 30 to 250° C. in the course of from 0.5 to 20 hours. The hydroxy-functional reagent is reacted with amounts of from about 1 to about 2 mol per mole of polymerized acid (derivative).

The additives according to the invention are added to the mineral oils or mineral oil distillates preferably as a mixture, the oil-soluble amphiphile A serving as a solvent for the copolymer B. Preferred mixtures are flowable at temperatures below 40° C., i.e. they have a viscosity of less than 10 Pas, in particular <1 Pas, at this temperature. If the viscosity and/or natural setting point of the mixture are too high for processing, up to 50% by weight, in particular up to 20% by weight, based on the additive, of a solvent may be added. Solvents may be aliphatic and/or aromatic hydrocarbons. The advantages of the additive combination according to the invention can however also be utilized in the case of separate metering of the components A and B.

Mineral oils or mineral oil distillates improved in their lubricating and/or cold flow properties by means of the additives contain from 0.001 to 2, preferably from 0.005 to 0.5,% by weight of additive, based on the distillate.

The additives according to the invention may furthermore be used in the form of mixtures which comprise additives of the claimed type but of different qualitative and/or quantitative composition. The mixing ratio (in parts by weight) of the additive components may be varied over a wide range and may be, for example, from 20:1 to 1:20, preferably from 10:1 to 1:10. In this way, the additives can be adapted specifically to individual requirements.

For the preparation of additive packets for solving specific problems, the additives according to the invention can also be used together with one or more oil-soluble coadditives which by themselves improve the cold flow properties and/or lubricating effect of crude oils, lubricating oils or fuel oils. Examples of such coadditives are vinyl acetate-containing copolymers or terpolymers of ethylene, polar compounds which disperse paraffins (paraffin dispersants), comb polymers, alkylphenol/aldehyde resins and oil-soluble amphiphiles.

Thus, mixtures of the additives with copolymers which contain from 10 to 40% by weight of vinyl acetate and from 60 to 90% by weight of ethylene have proven to be particularly useful. According to a further embodiment of the invention, the additives according to the invention are used as a mixture with ethylene/vinyl acetate/vinyl neononanoate terpolymers or ethylene/vinyl acetate/vinyl neodecanoate terpolymers for improving the flowability of mineral oils or mineral oil distillates. The terpolymers of vinyl neononanoates or of vinyl neodecanoates contain from 10 to 35% by weight of vinyl acetate and from 1 to 25% by weight of the respective neo compound in addition to ethylene. Further preferred copolymers contain, in addition to ethylene and from 10 to 35% by weight of vinyl esters, also from 0.5 to 20% by weight of olefin, such as diisobutylene, 4-methylpentene or norbornene. The mixing ratio of the additives according to the invention with the ethylene/vinyl acetate copolymers described above or the terpolymers of ethylene, vinyl acetate and the vinyl esters of neononanoic or neodecanoic acid is (in parts by weight) from 20:1 to 1:20, preferably from 10:1 to 1:10.

For use as flow improvers and/or lubricity additives, the additives according to the invention may furthermore be used as a mixture with paraffin dispersants. Paraffin dispersants reduce the size of the paraffin crystals and ensure that the paraffin particles do not settle out but remain dispersed in colloidal form with substantially reduced tendency to sedimentation. Furthermore, they enhance the lubricating effect of the additives according to the invention. Paraffin dispersants which have proven to be useful are oil-soluble polar compounds having ionic or polar groups, for example amine salts and/or amides, which are obtained by reacting aliphatic or aromatic amines, preferably long-chain aliphatic amines, with aliphatic or aromatic mono-, di-, tri- or tetracarboxylic acids or their anhydrides (cf. U.S. Pat. No. 4,211,534). Other paraffin dispersants are copolymers of maleic anhydride and α,β-unsaturated compounds, which, if required, may be reacted with primary monoalkylamines and/or aliphatic alcohols (cf. EP 0 154 177), the reaction products of alkenylspirobislactones with amines (cf. EP 0 413 279 B1) and, according to EP 0 606 055 A2, reaction products of terpolymers based on α,β-unsaturated dicarboxylic anhydrides, α,β-unsaturated compounds and polyoxyalkylene ethers of lower unsaturated alcohols. Alkylphenol aldehyde resins are also suitable as paraffin dispersants.

Thus, the copolymers according to the invention can be used as a mixture with alkylphenol formaldehyde resins. In a preferred embodiment of the invention, these alkylphenol formaldehyde resins are those of the formula 7

(7)

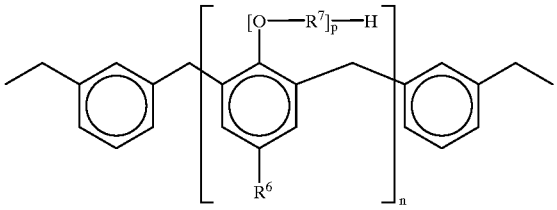

in which $R^6$ is $C_4$–$C_{50}$-alkyl or $C_4$–$C_{50}$-alkenyl, $R^7$ is ethoxy and/or propoxy, n is a number from 5 to 100 and p is a number from 0 to 50.

Finally, in a further embodiment of the invention, the additives according to the invention are used together with comb polymers. These are understood as meaning polymers in which hydrocarbon radicals having at least 8, in particular at least 10, carbon atoms are bonded to a polymer backbone. Preferably, these are homopolymers whose alkyl side chains contain at least 8 and in particular at least 10 carbon atoms. In the case of copolymers, at least 20%, preferably at least 30%, of the monomers have side chains (cf. Comb-like Polymers—Structures and Properties; N. A. Platé and V. P. Shibaev, J. Polym. Sci. Macromolecular Revs. 1974, 8, 117 et seq.). Examples of suitable comb polymers are fumarate/vinyl acetate copolymers (cf. EP 0 153 176 A1), copolymers of a $C_6$- to $C_{24}$-α-olefin and an N-$C_6$- to $C_{22}$-alkylmaleimide (cf. EP 0 320 766), and furthermore esterified olefin/maleic anhydride copolymers, polymers and copolymers of α-olefins and esterified copolymers of styrene and maleic anhydride.

Comb polymers can be described, for example, by the formula 8

(8)

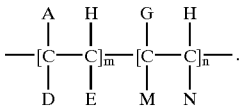

In this formula,

A is R', COOR', OCOR', R"—COOR' or OR';

D is H, $CH_3$, A or R;

E is H or A;

G is H, R", R"—COOR', an aryl radical or a heterocyclic radical;

M is H, COOR", OCOR", OR" or COOH;

N is H, R", COOR", OCOR, COOH or an aryl radical;

R' is a hydrocarbon chain having 8–150 carbon atoms

R" is a hydrocarbon chain having 1 to 10 carbon atoms;

m is a number from 0.4 to 1.0; and n is a number from 0 to 0.6.

The mixing ratio (in parts by weight) of the additives according to the invention with paraffin dispersants, resins or comb polymers is in each case from 1:10 to 20:1, preferably from 1:1 to 10:1.

The additives according to the invention are suitable for improving the lubricating properties of animal, vegetable or mineral oils in only low doses. Moreover, they simultaneously improve the cold flow properties of the oils containing the additives. The emulsification properties of the oils containing the additives are impaired to a lesser extent than with the lubricity additives of the prior art. The additives according to the invention are particularly suitable for use in middle distillates. Middle distillates are defined in particular as those mineral oils which are obtained by distillation of crude oil and boil within a range from 120 to 450° C., for example kerosene, jet fuel, diesel and heating oil. Preferably, the additives according to the invention are used in those middle distillates which contain 0.05% by weight of sulfur or less, particularly preferably less than 350 ppm of sulfur, in particular less than 200 ppm of sulfur and in specific cases less than 50 ppm of sulfur. These are in general those middle distillates which are subjected to refining with hydrogenation and which therefore contain only small amounts of polyaromatic and polar compounds which impart a natural lubricating reaction to them. The additives according to the invention are furthermore preferably used in those middle distillates which have 95% distillation points below 370° C., in particular 350° C. and in specific cases below 330° C. They can also be used as components in lubricating oils.

The additives can be used alone or together with other additives, for example with other pour point depressants or dewaxing assistants, with corrosion inhibitors, antioxidants, sludge inhibitors, dehazers and additives for reducing the cloud point.

EXAMPLES

The efficiency of the additives according to the invention as lubricity additives is illustrated in more detail by the examples below.

The polymers A1-A4 were prepared by high-pressure mass polymerization of ethylene, vinyl acetate and hydroxy-functional comonomers according to DE-A-197 57 830.

The hydroxy-functional comonomers are determined by determining the OH number by reacting the polymer with excess acetic anhydride and subsequently titrating the acetic acid formed with KOH.

The viscosity is determined according to ISO 3219 (B) using a rotational viscometer (Haake RV 20) with plate-and-cone measuring system at 140 and 160° C.

TABLE 1

Characterization of the hydroxy-functional copolymers

| Example No. | Comonomer(s) |
|---|---|
| A1 | Terpolymer of ethylene, 24% by weight of vinyl acetate and 9% by weight of hydroxyethyl methacrylate, having a melt viscosity at 140° C. of 200 mPas and an OH number of 43 mg KOH/g |
| A2 | Terpolymer of ethylene, 24% by weight of vinyl acetate and 12% by weight of hydroxyethyl vinyl ether, having a melt viscosity at 140° C. of 120 mPas and an OH number of 78 mg KOH/g |
| A3 | Copolymer of ethylene and hydroxypropyl acrylate, having a melt viscosity at 140° C. of 138 mPas and an OH number of 145 mg KOH/g |
| A4 | Terpolymer of ethylene, dimethylvinylcarbinol and 15% by weight of vinyl neodecanoate, having a melt viscosity at 140° C. of 100 mPas and an OH number of 48 mg KOH/g |

TABLE 2

Characterization of the oil-soluble amphiphiles

| Sample | |
|---|---|
| B1 | Oleic acid |
| B2 | Tall oil fatty acid |
| B3 | Glyceryl monooleate |
| B4 | Poly(isobutenyl)succinic anhydride, diesterified with diethylene glycol according to Example 1 of WO 97/45507 |
| B5 | Oleic acid diethanolamide |
| B6 | Glyceryl monooctadecyl ether |

TABLE 3

Characterization of the test oils
The boiling characteristics are determined according to ASTM D-86, the CFPP value according to EN 116 and the cloud point according to ISO 3015.

| | Test oil 1 | Test oil 2 | Test oil 3 |
|---|---|---|---|
| Initial boiling point [° C.] | 182 | 171 | 188 |
| 20% [° C.] | 202 | 227 | 220 |
| 30% [° C.] | 208 | 243 | 228 |
| 90% [° C.] | 286 | 322 | 270 |
| 95% [° C.] | 302 | 338 | 278 |
| Cloud point [° C.] | −29 | −9.4 | −29 |
| CFPP [° C.] | −32 | −11 | −33 |
| S content [ppm] | 3 | 38 | 6 |
| Density [g/cm$^3$] | 0.819 | 0.830 | 0.810 |
| WS 1.4 [$\mu$m] | 679 | 555 | 626 |

Lubricating Effect in Middle Distillates

The lubricating effect of the additives was determined by means of an HFRR apparatus from PCS Instruments on additive-containing oil at 60° C. The High Frequency Reciprocating Rig Test (HFRR) is described in D. Wei, H. Spikes, Wear, Vol. 111, No. 2, p. 217, 1986. The results are stated as coefficient of friction and wear scar (WS 1.4). A low coefficient of friction and a low wear scar indicate a good lubricating effect.

TABLE 4

Wear scar in test oil 1

| Example | Additive | Wear scar | Friction | Film |
|---|---|---|---|---|
| 1 | 150 ppm A1 50% in B1 | 437 | 0.21 | 49 |
| 2 | 200 ppm A1 50% in B1 | 375 | 0.16 | 69 |
| 3 | 400 ppm A1 50% in B1 | 310 | 0.13 | 67 |
| 4 | 100 ppm A1 50% in B3 | 406 | 0.17 | 67 |
| 5 | 300 ppm A1 50% in B3 | 193 | 0.13 | 94 |
| 6 | 250 ppm A2 50% in B2 | 276 | 0.14 | 73 |
| 7 | 200 ppm A3 50% in B4 | 318 | 0.15 | 69 |
| 8 | 200 ppm A2 50% in B5 | 290 | 0.14 | 75 |
| 9 | 200 ppm A3 50% in B6 | 370 | 0.16 | 71 |
| 10 (Comp.) | 600 ppm A1 (50% in SN) | 484 | 0.29 | 14 |
| 11 (Comp.) | 600 ppm A2 (50% in SN) | 473 | 0.26 | 19 |
| 12 (Comp.) | 150 ppm B1 | 435 | 0.18 | 51 |
| 13 (Comp.) | 100 ppm B3 | 389 | 0.18 | 72 |

TABLE 5

Wear scar in test oil 2

| Example | Additive | Wear scar | Friction | Film |
|---|---|---|---|---|
| 14 | 100 ppm A1 50% in B1 | 380 | 0.18 | 69 |
| 15 | 200 ppm A1 50% in B1 | 355 | 0.16 | 71 |
| 16 | 300 ppm A1 50% in B1 | 344 | 0.16 | 73 |
| 17 | 200 ppm A1 50% in B3 | 385 | 0.19 | 67 |
| 18 | 300 ppm A1 50% in B3 | 183 | 0.12 | 93 |
| 19 | 150 ppm A4 50% in B5 | 365 | 0.17 | 74 |
| 20 | 150 ppm A4 50% in B6 | 420 | 0.19 | 65 |
| 21 (Comp.) | 100 ppm A1 (50% in SN) | 572 | 0.30 | 29 |
| 22 (Comp.) | 200 ppm A1 (50% in SN) | 552 | 0.27 | 40 |
| 23 (Comp.) | 300 ppm A1 (50% in SN) | 348 | 0.17 | 87 |
| 24 (Comp.) | 300 ppm B1 | 334 | 0.14 | 66 |
| 25 (Comp.) | 100 ppm B3 | 430 | 0.21 | 50 |
| 26 | 100 ppm A3 50% in B1 | 380 | 0.18 | 69 |
| 27 | 200 ppm A3 50% in B1 | 355 | 0.16 | 71 |
| 28 | 300 ppm A3 50% in B1 | 344 | 0.16 | 73 |
| 29 | 200 ppm A3 50% in B3 | 385 | 0.19 | 67 |
| 30 | 300 ppm A3 50% in B3 | 183 | 0.12 | 93 |

TABLE 6

Wear scan in test oil 3

| Example | Additive | Wear scar | Friction | Film |
|---|---|---|---|---|
| 31 | 300 ppm A3 50% in B1 | 381 | 0.16 | 68 |
| 32 | 400 ppm A3 50% in B1 | 364 | 0.15 | 69 |
| 33 (Comp.) | 200 ppm A3 (50% in SN) | 632 | 0.34 | 16 |
| 34 (Comp.) | 300 ppm A3 (50% in SN) | 593 | 0.29 | 36 |
| 35 (Comp.) | 400 ppm A3 (50% in SN) | 303 | 0.16 | 87 |
| 36 (Comp.) | 300 ppm B1 | 367 | 0.17 | 68 |

Tendency to Emulsify in Middle Distillates

The tendency to emulsify is determined according to ASTM D-1094–85. For this purpose, the additive to be tested is added to 80 ml of the diesel fuel in a 100 ml cylinder and thermostated and shaken for 15 min at 60° C. After cooling to room temperature, 20 ml of the buffer solution pH 7.0 are added and shaking is effected for 2 minutes. After 5 minutes, the sample is assessed visually.

Assessment of the Boundary Layer

1 Clear and clean

1b Small, clear bubbles which are estimated to cover no more than 50% of the boundary layer. No streaks, no film formation or other wetting at the boundary layer.

2 Streaks, film formation or other wetting at the boundary layer.

3 Narrow border or slight foam formation or both.

4 Thick border or considerable foam formation or both.

Evaluation of the Phase Separation

1 Complete absence of all emulsions and/or deposits in both phases or on top of the oil phase.

2 Streaks, film formation or other wetting of the boundary layer.

3 Emulsions and/or precipitates in both phases or on top of the oil phase, and/or drops in the aqueous phase or adhering to the wall (except for the wall above the oil phase). The amount of the aqueous phase is shown in brackets.

TABLE 7

Emulsification test in test oil 1

| Example | Additive A | Additive B | Boundary layer | Phase separation |
|---|---|---|---|---|
| 37 (Comp.) | 250 ppm A1 | — | 1b | 3 (20 ml) |
| 38 (Comp.) | 250 ppm A3 | — | 1b | 2 (20 ml) |
| 39 (Comp.) | — | 250 ppm B1 | 3 | 2 (18 ml) |
| 40 (Comp.) | — | 250 ppm B3 | 3 | 3 ( 6 ml) |
| 41 | 125 ppm A1 | 125 ppm B1 | 1b | 3 (20 ml) |
| 42 | 250 ppm A1 | 250 ppm B1 | 1b | 3 (20 ml) |
| 43 | 125 ppm A1 | 125 ppm B3 | 1b | 2 (20 ml) |
| 44 | 250 ppm A1 | 250 ppm B3 | 1b | 3 (20 ml) |
| 45 | 125 ppm A3 | 125 ppm B1 | 1b | 2 (20 ml) |

TABLE 8

Emulsification test in test oil 2

| Example | Additive A | Additive B | Boundary layer | Phase separation |
|---|---|---|---|---|
| 46 (Comp.) | 250 ppm A3 | — | 1b | 2 (20 ml) |
| 47 (Comp.) | — | 250 ppm B1 | 2 | 2–3 (18 ml) |
| 48 (Comp.) | — | 250 ppm B3 | 2 | 2–3 (17 ml) |
| 49 | 125 ppm A3 | 125 ppm B1 | 1b | 2 (20 ml) |
| 50 | 125 ppm A3 | 125 ppm B3 | 1b | 2 (20 ml) |

TABLE 9

Emulsification test in test oil 3

| Example | Additive A | Additive B | Boundary layer | Phase separation |
|---|---|---|---|---|
| 51 (Comp.) | 250 ppm A3 | — | 1b | 1–2 (20 ml) |
| 52 (Comp.) | | | | |
| 53 (Comp.) | — | 250 ppm B1 | 2–3 | 2–3 (18 ml) |
| 54 | | | | |
| 55 | 125 ppm A3 | 125 ppm B1 | 1b | 2 (20 ml) |

What is claimed is:

1. An additive for improving lubricating properties of fuel oils, comprising A) 10–95% by weight of at least one oil-soluble amphiphile of the formulae 1

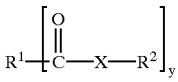

(1)

and/or 2

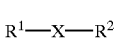

(2)

in which $R^1$ is an alkyl or hydroxyalkyl having 1 to 50 carbon atoms or an alkenyl or an aromatic radical having from 5 to 50 carbon atoms, X is O or S, y is 1, 2, 3 or 4, $R^2$ is hydrogen or an alkyl radical carrying hydroxyl groups arid having 2 to 10 carbon atoms and B) 5–90% by weight of at least one copolymer which contains B1) from 0.5 to 15 mol % of structural units which are derived from olefinically unsaturated compounds which have at least one free hydroxyl group, and B2) from 85 to 99.5 mol % of structural units which are derived from ethylene, and, if required, B3) from 0 to 20 mol % of further structural units selected from the group consisting of (meth)acrylic acid, (meth) acrylates, vinyl esters, vinyl ethers and alkenes, with the proviso that the structural units stated under B3) differ from the structural units stated under B1) and B2), and the copolymer has an average molar mass Mw of from 500 to 100,000 g/mol and an OH number of from 5 to 300 mg KOH/g.

2. The additive as claimed in claim 1, the copolymer B having an OH number of from 15 to 200 mg KOH/g.

3. The additive as claimed in claim 1, the copolymer having an average molecular weight Mw of from 700 to 10,000 g/mol.

4. The additive as claimed in claim 1, the proportion of structural units B1 being from 1 to 15 mol %.

5. The additive as claimed in claim 1, the oil-soluble amphiphile being a fatty acid having 10 to 18 carbon atoms, or an ester derived from such a fatty acid.

6. A fuel oil comprising a middle distillate having a sulfur content of 0.05% by weight or less, and from 0.001 to 2% by weight of an additive as claimed in claim 1.

7. A process for improving lubricity of a middle distillate having a sulfur content of 0.05% by weight or less, said process comprising adding to said middle distillate the additive of claim 1.

8. An additive mixture comprising the additive as claimed in claim 1, flow improvers, comb polymers, and/or paraffin dispersants.

* * * * *